US009788635B2

(12) United States Patent
Tani

(10) Patent No.: US 9,788,635 B2
(45) Date of Patent: Oct. 17, 2017

(54) ROD-SHAPED COSMETIC MATERIAL FEEDING CONTAINER

(71) Applicant: TOKIWA Corporation, Nakatsugawa-shi, Gifu (JP)

(72) Inventor: Yoshikazu Tani, Kawaguchi (JP)

(73) Assignee: TOKIWA CORPORATION, Nakatsugawa-shi (JP)

( * ) Notice: Subject to any disclaimer, the term of this patent is extended or adjusted under 35 U.S.C. 154(b) by 0 days.

(21) Appl. No.: 15/196,199

(22) Filed: Jun. 29, 2016

(65) Prior Publication Data

US 2017/0000240 A1 Jan. 5, 2017

(30) Foreign Application Priority Data

Jul. 1, 2015 (JP) ..... 2015-132761

(51) Int. Cl.
*A45D 40/06* (2006.01)
*A45D 40/20* (2006.01)

(52) U.S. Cl.
CPC ..... *A45D 40/06* (2013.01); *A45D 40/20* (2013.01)

(58) Field of Classification Search
None
See application file for complete search history.

(56) References Cited

U.S. PATENT DOCUMENTS 7,857,538 B2 * 12/2010 Nasu ..... A45D 34/04 401/171
8,328,447 B2 * 12/2012 Tani ..... A45D 40/04 401/172
8,562,232 B2 * 10/2013 Ishida ..... A45D 40/04 401/68
2015/0030371 A1 1/2015 Tani
2016/0022005 A1 1/2016 Suzuki

FOREIGN PATENT DOCUMENTS

JP 0203370 Y2 9/1990
JP 2015-043961 A 3/2015
JP 2016022260 A 2/2016

OTHER PUBLICATIONS

Japanese Office Action for Application No. 2015-132761 dated Aug. 23, 2017.

* cited by examiner

*Primary Examiner* — David Walczak
(74) *Attorney, Agent, or Firm* — Isshiki International Law Office; Joseph P. Farrar, Esq.

(57) ABSTRACT

A rod-shaped cosmetic material feeding container in which a leading tube and a container main body are relatively rotated in one direction, an action of a screw part moves a rod-shaped cosmetic material supporting body to reach a movement limit, and then the leading tube and the container main body are further relatively rotated in the one direction. With movement of the rod-shaped cosmetic material supporting body stopped, while a spring portion in a rotation stopper tube shrinks, the screw part screws forward to release screwing of the screw part. Additionally, the movement of the rod-shaped cosmetic material supporting body is stopped and therefore the rod-shaped cosmetic material supporting body does not move back and forth in an axial direction. Accordingly, a rod-shaped cosmetic material does not move back and forth in the axial direction as well, thereby ensuring minimizing an impact to the rod-shaped cosmetic material.

20 Claims, 10 Drawing Sheets

ROD-SHAPED COSMETIC MATERIAL FEEDING CONTAINER

CROSS-REFERENCE TO RELATED APPLICATION

The present application is based on and claims priority pursuant to 35 U.S.C. §119 to Japanese Patent Application Serial No. 2015-132761, filed Jul. 1, 2015, the entire disclosure of which is hereby incorporated herein by reference.

BACKGROUND

Technical Field

The present disclosure relates to a rod-shaped cosmetic material feeding container.

Background Art

Conventionally, as a rod-shaped cosmetic material feeding container, there has been known a rod-shaped cosmetic material feeding container disclosed in the following Patent Literature 1. The rod-shaped cosmetic material feeding container disclosed in Patent Literature 1 includes a leading tube (a front container part), a shaft tube (a rear container part), a spiral tube, an advancing/retreating shaft, a solid cosmetic material (a rod-shaped cosmetic material), a compression spring, and an annular packing. The shaft tube is rotatable with respect to the front container part around an axis line. The spiral tube is movable inside the rear container part in an axial direction, unrotatable around the axis line, and includes a female screw at the inner peripheral. The advancing/retreating shaft is movable inside the front container part in the axial direction, unrotatable around the axis line, and includes a protrusion, which engages the female screw, at a rear end. The solid cosmetic material is supported to a distal end of the advancing/retreating shaft. The compression spring at least is able to absorb a length of the protrusion in the axial direction between the front container part and the spiral tube. The annular packing is disposed between the compression spring and the spiral tube.

Especially, with the rod-shaped cosmetic material feeding container, after a relative rotation of the front container part and the rear container part in one direction moves the advancing/retreating shaft, when the front container part and the rear container part are further relatively rotated in this one direction, a screwed screw part, which is constituted of the protrusion and the female screw, is released. This achieves minimizing damage to the container caused by, for example, a bite of the screw part and a decomposition of the front container part and the rear container part.

CITATION LIST

Patent Literature

Patent Literature 1: Japanese Unexamined Utility Model Publication H02-33703

SUMMARY

Technical Problem

Assume that, after the front container part and the rear container part of the rod-shaped cosmetic material feeding container are relatively rotated in the one direction and a movable body moves, the front container part and the rear container part are further relatively rotated in the one direction. The movable body further moves, and the screwed screw part is released. Subsequently, a spring portion presses back the movable body to recover the screwing of the screw part. Repeating the release of screwing and the recovery of screwing of the screw part causes the movable body to move back and forth in the axial direction. The rod-shaped cosmetic material, which is supported to the distal end of the movable body, also moves back and forth in the axial direction, possibly impacting the rod-shaped cosmetic material. This possibly breaks off or drops the rod-shaped cosmetic material, therefore, there is room for improvement in providing sufficient protection of the rod-shaped cosmetic material.

The present disclosure provides a rod-shaped cosmetic material feeding container that can sufficiently protect a rod-shaped cosmetic material while minimizing damage to a container.

A rod-shaped cosmetic material feeding container according to the present disclosure includes a tubular container, a movable body, and a rotation stopper tube. The tubular container has a front container part and a rear container part. The movable body is engaged with the front container part in a rotation direction around an axis line. The movable body is movable in an axial direction, supports a rod-shaped cosmetic material at a distal end and includes a male screw at an outer peripheral portion. The rotation stopper tube is rotatable with respect to the front container part around the axis line. The rotation stopper tube is synchronously rotatable with respect to the rear container part around the axis line and includes a female screw at an inner peripheral portion. The female screw is screwed with the male screw. The relative rotation of the front container part and the rear container part works a screw part constituted of the male screw and the female screw to advance and retreat the movable body, the relative rotation causes the rod-shaped cosmetic material to appear and disappear from an opening at a distal end of the container. The rotation stopper tube includes a spring portion expandable and contractible in the axial direction. If the front container part and the rear container part are relatively rotated in one direction, the movable body moves and reaches a movement limit, and the front container part and the rear container part are further relatively rotated in the one direction, the screw part screws forward while the spring portion shrinks with the movement of the movable body stopped to release the screwing of the screw part.

With the rod-shaped cosmetic material feeding container, when the front container part and the rear container part are relatively rotated in the one direction, the movable body moves and reaches the movement limit, and then the front container part and the rear container part are further relatively rotated in the one direction, with the movement of the movable body stopped, the screw part screws forward while the spring portion shrinks to release the screwing of the screw part. Accordingly, even if this relative rotation is further continued, the screw part released from the screwing idles. This does not generate a force to further move the movable body that has reached the movement limit by the screw part, thereby ensuring minimizing damage to the container. At this time, the movement of the movable body is stopped, and therefore the movable body does not move back and forth in the axial direction. Therefore, the rod-shaped cosmetic material, which is supported to the distal end of the movable body, does not move back and forth in the axial direction as well, thereby ensuring minimizing an impact to the rod-shaped cosmetic material. Thus, the rod-shaped cosmetic material can be sufficiently protected while the damage of the container is restrained.

Herein, the movement limit may be at least either one of a forward limit and a backward limit.

It may be such that the movable body includes a thin-diameter portion positioned adjacent to an end portion of the male screw, the thin-diameter portion has an outer diameter smaller than an inner diameter of the female screw, and if the movable body moves and reaches the movement limit and the front container part and the rear container part are further relatively rotated in the one direction, while the spring portion shrinks, the screw part screws forward and the female screw reaches the thin-diameter portion with the movement of the movable body stopped to release the screwing of the screw part. In this case, while the screw part shrinks, when the screw part screws forward with the movement of the movable body stopped, reaching the female screw to the thin-diameter portion ensures releasing the screwing of the screw part.

With the screwing of the screw part released, an elastic force by the shrunk spring portion may bias the female screw to the male screw. In this case, with the screwing of the screw part released, relatively rotating the front container part and the rear container part in the other direction allows the female screw and the male screw released from the screwing to easily recover the screwing by the elastic force from the spring portion.

It may be such that if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released. In this case, when the front container part and the rear container part are relatively rotated in the other direction, the movable body moves and reaches the other movement limit, and then the front container part and the rear container part are further relatively rotated in the other direction, the synchronous rotation between the rotation stopper tube and the rear container part is released. This stops the relative rotation between the rotation stopper tube, which includes the female screw, and the movable body, which includes the male screw. This configuration does not generate a force to further move the movable body that has reached the other movement limit by the screw part, thereby ensuring minimizing the damage of the container.

It may be such that the rear container part includes a plurality of ribs extending in the axial direction at an inner peripheral portion. The rotation stopper tube includes a rotation stopper vent portion, the rotation stopper vent portion includes a convex portion projecting radially outward, and the rotation stopper vent portion has flexibility in a direction along a radial direction. Engaging the convex portion between the ribs which are adjacent ensures a synchronous rotation with respect to the rear container part around the axis line. When the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line. This ensures preferably providing the action of releasing the synchronous rotation between the rotation stopper tube and the rear container part around the axis line.

It may be such that the spring portion absorbs an external force applied to the rod-shaped cosmetic material by the elastic force of the spring portion. The external force is transmitted from the rod-shaped cosmetic material to the rotation stopper tube via the movable body and the screw part. Accordingly, the external force applied to the rod-shaped cosmetic material can be absorbed by the elastic force from the spring portion, allowing further sufficiently protecting the rod-shaped cosmetic material.

Advantageous Effects

The present disclosure ensures providing a rod-shaped cosmetic material feeding container that can sufficiently protect a rod-shaped cosmetic material while minimizing damage to a container.

DESCRIPTION OF EMBODIMENTS

Figure 1:
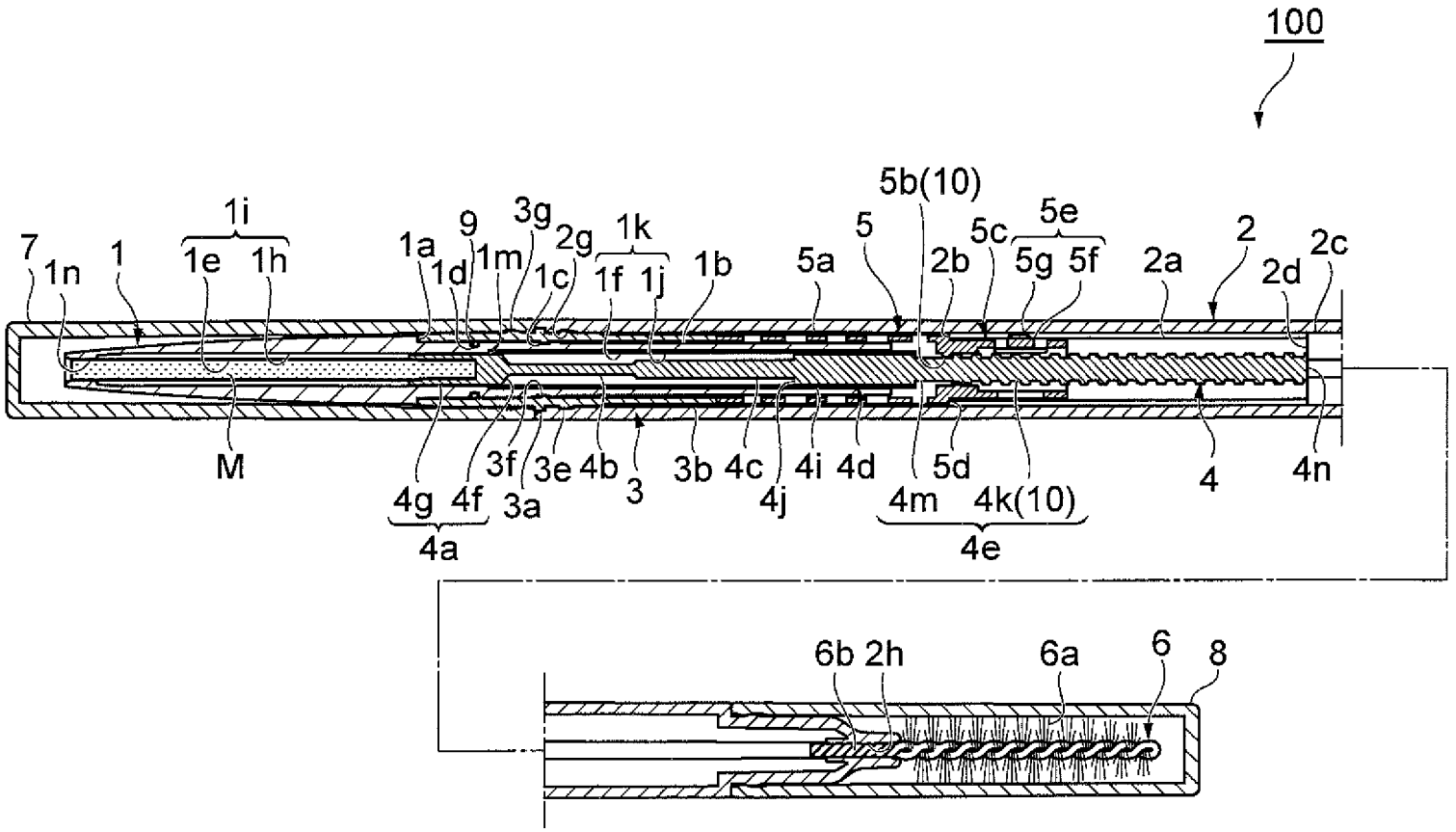
FIG. 1 is a vertical cross-sectional view illustrating an initial state of a rod-shaped cosmetic material feeding container according to one embodiment of the present disclosure and a state of a rod-shaped cosmetic material supporting body reaching a backward limit.
Figure 2:
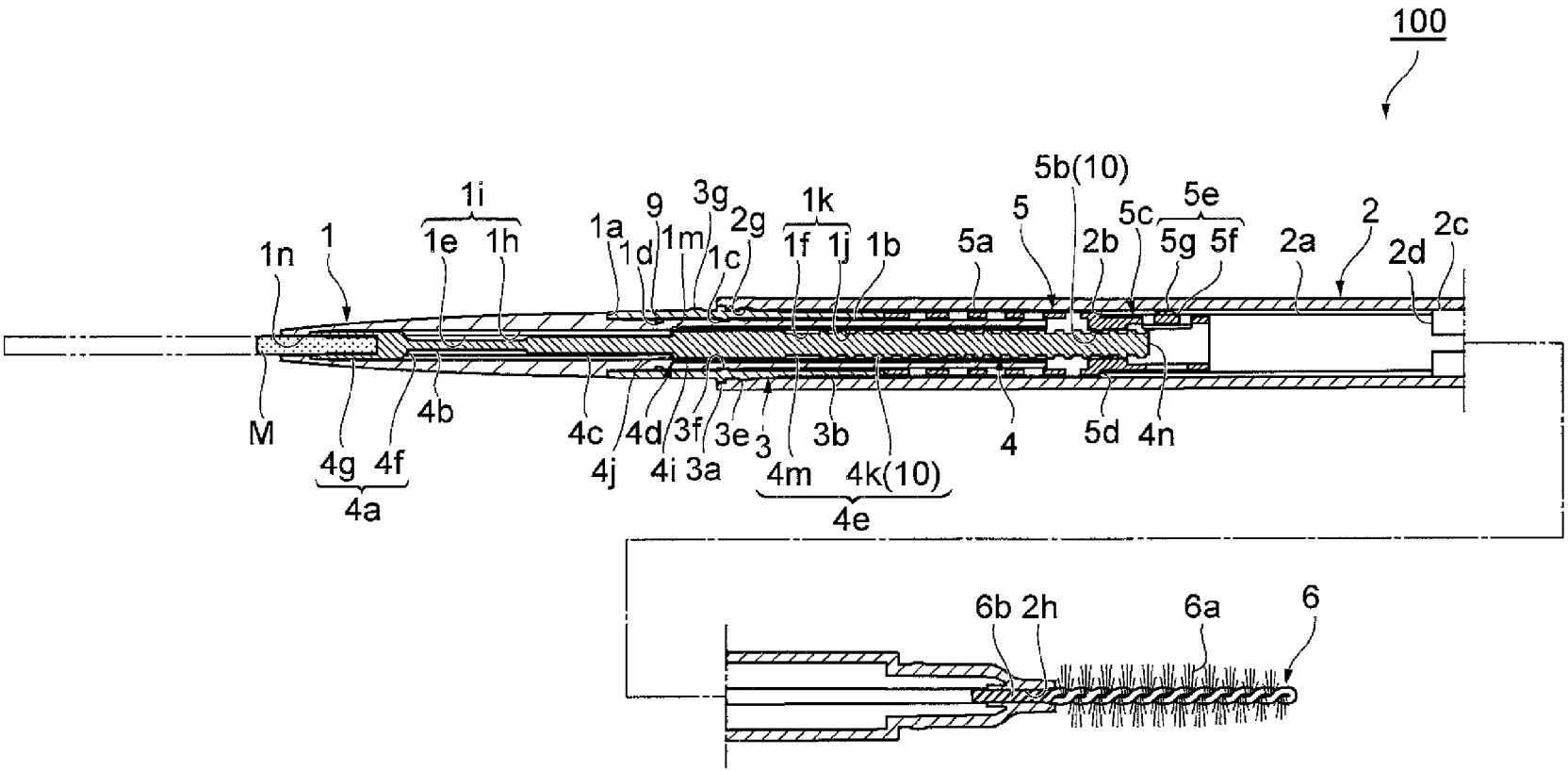
FIG. 2 is a vertical cross-sectional view illustrating a state where a cap is removed from the state illustrated in FIG. 1 and the rod-shaped cosmetic material supporting body reaches a forward limit by a user's operation.
Figure 3:
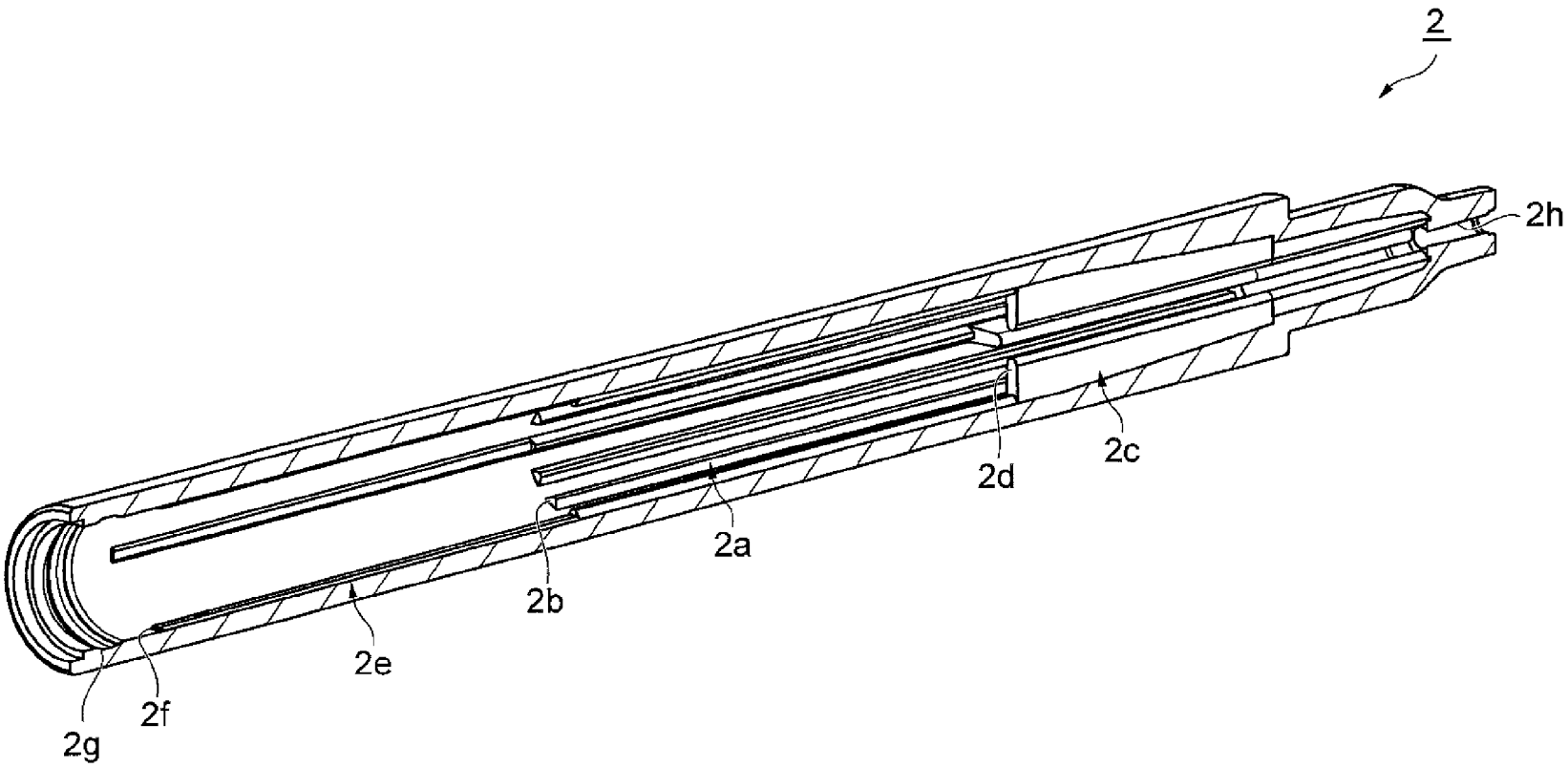
FIG. 3 is a perspective view illustrating a vertical cross section of a container main body in FIG. 1.
Figure 4:
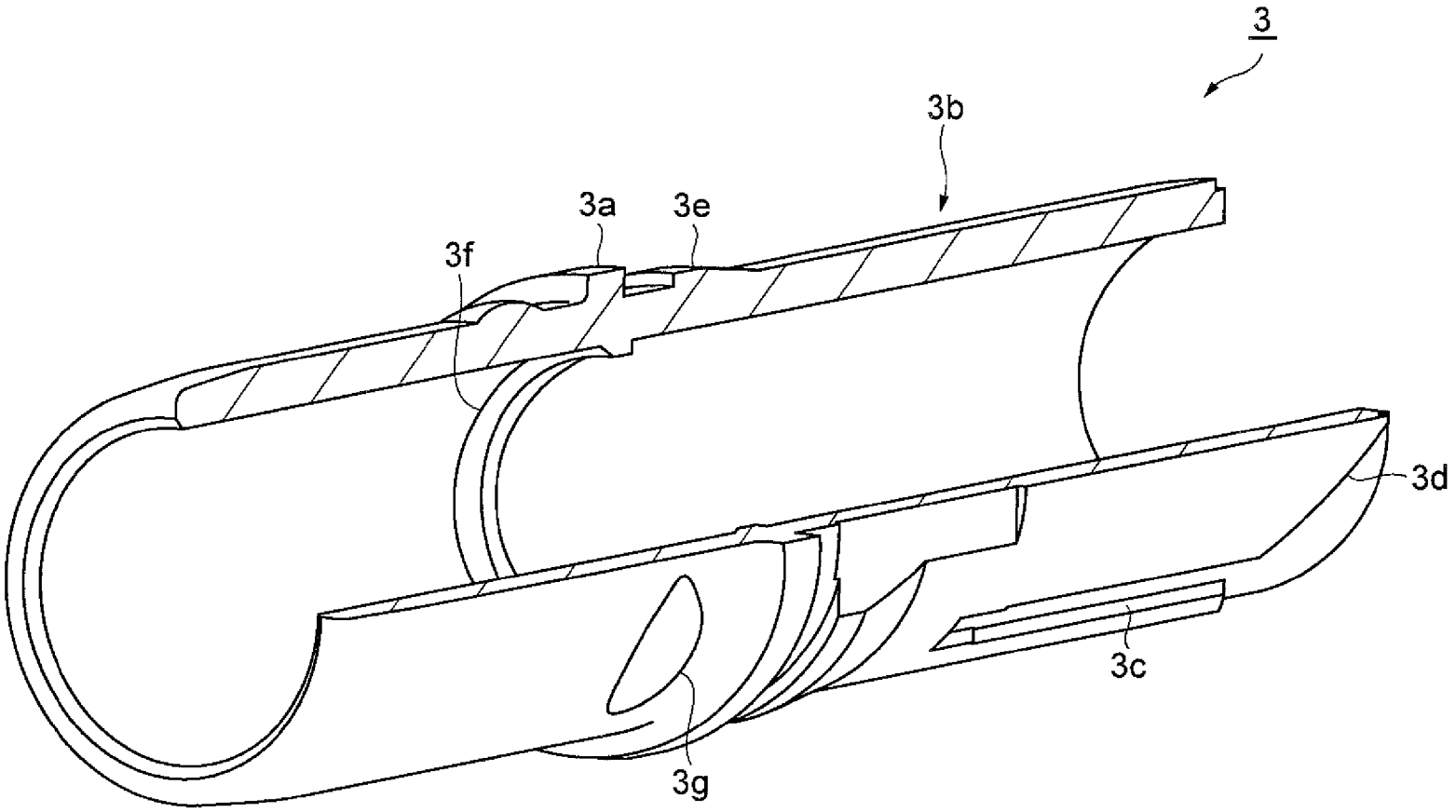
FIG. 4 is a perspective view illustrating a cross section of a part of a joint tube in FIG. 1.
Figure 5:
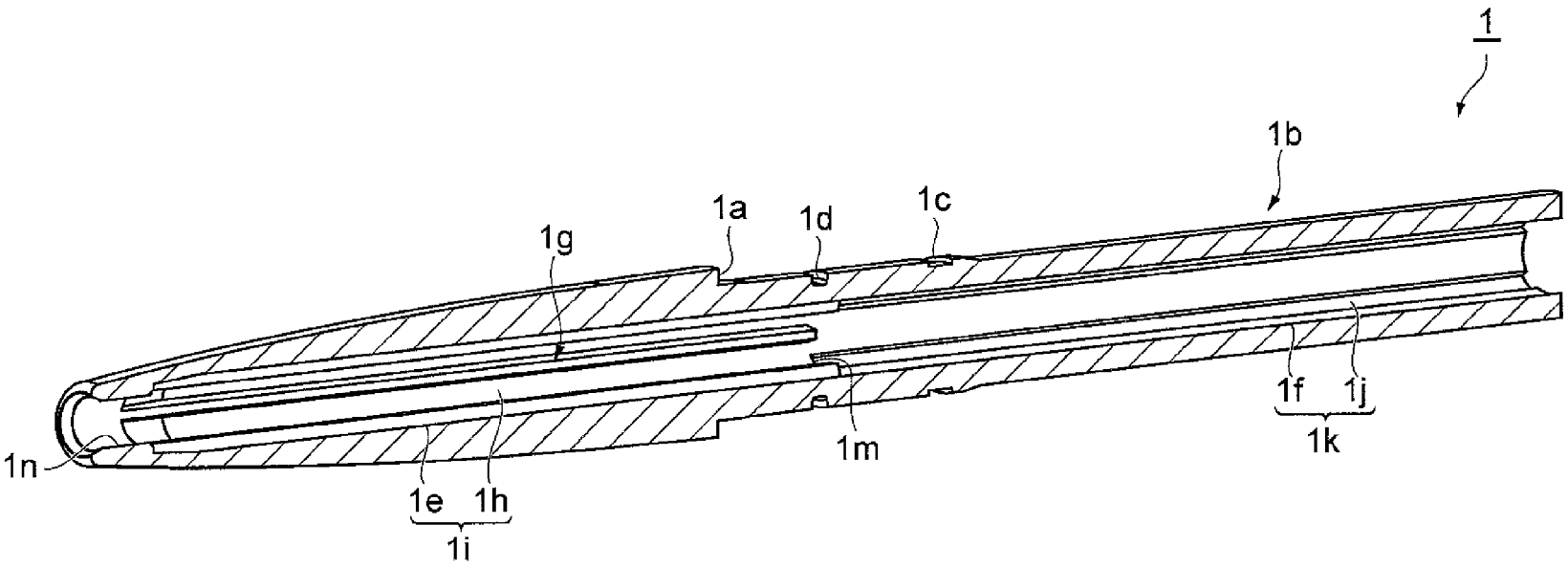
FIG. 5 is a perspective view illustrating a vertical cross section of a leading tube in FIG. 1.
Figure 6:
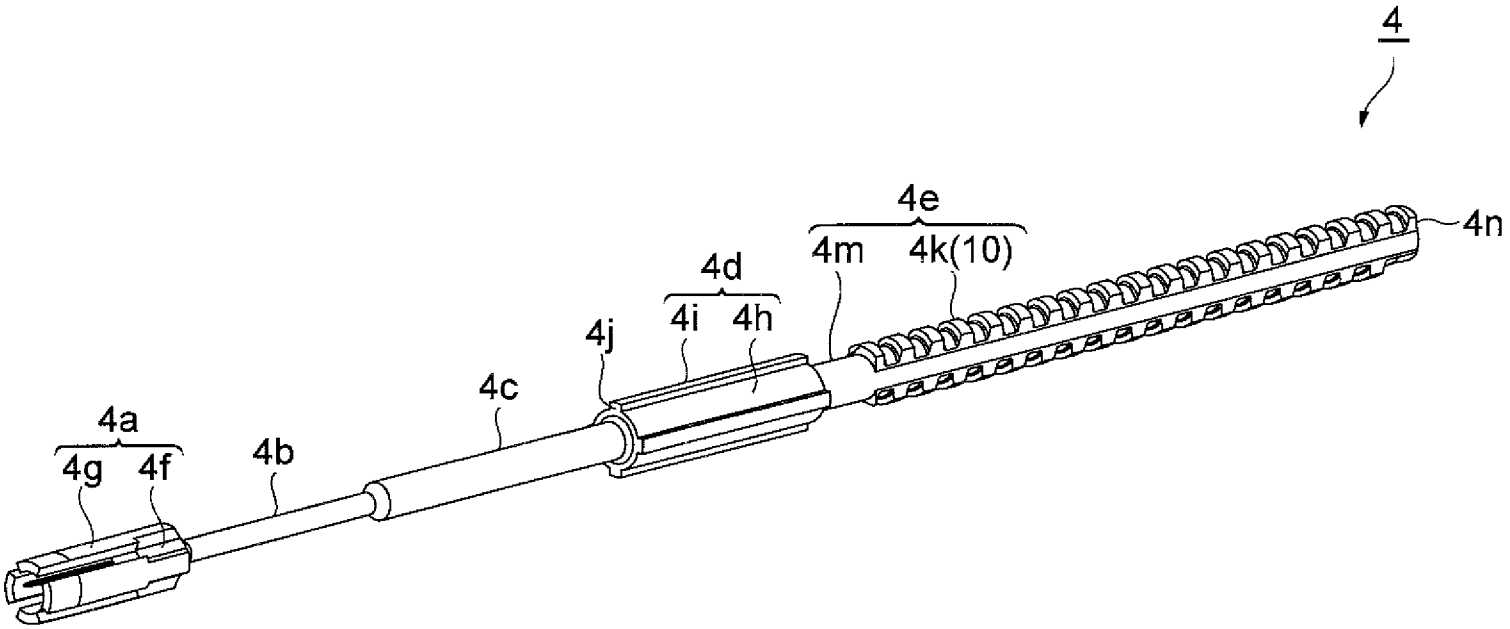
FIG. 6 is a perspective view illustrating the rod-shaped cosmetic material supporting body in FIG. 1.
Figure 7:
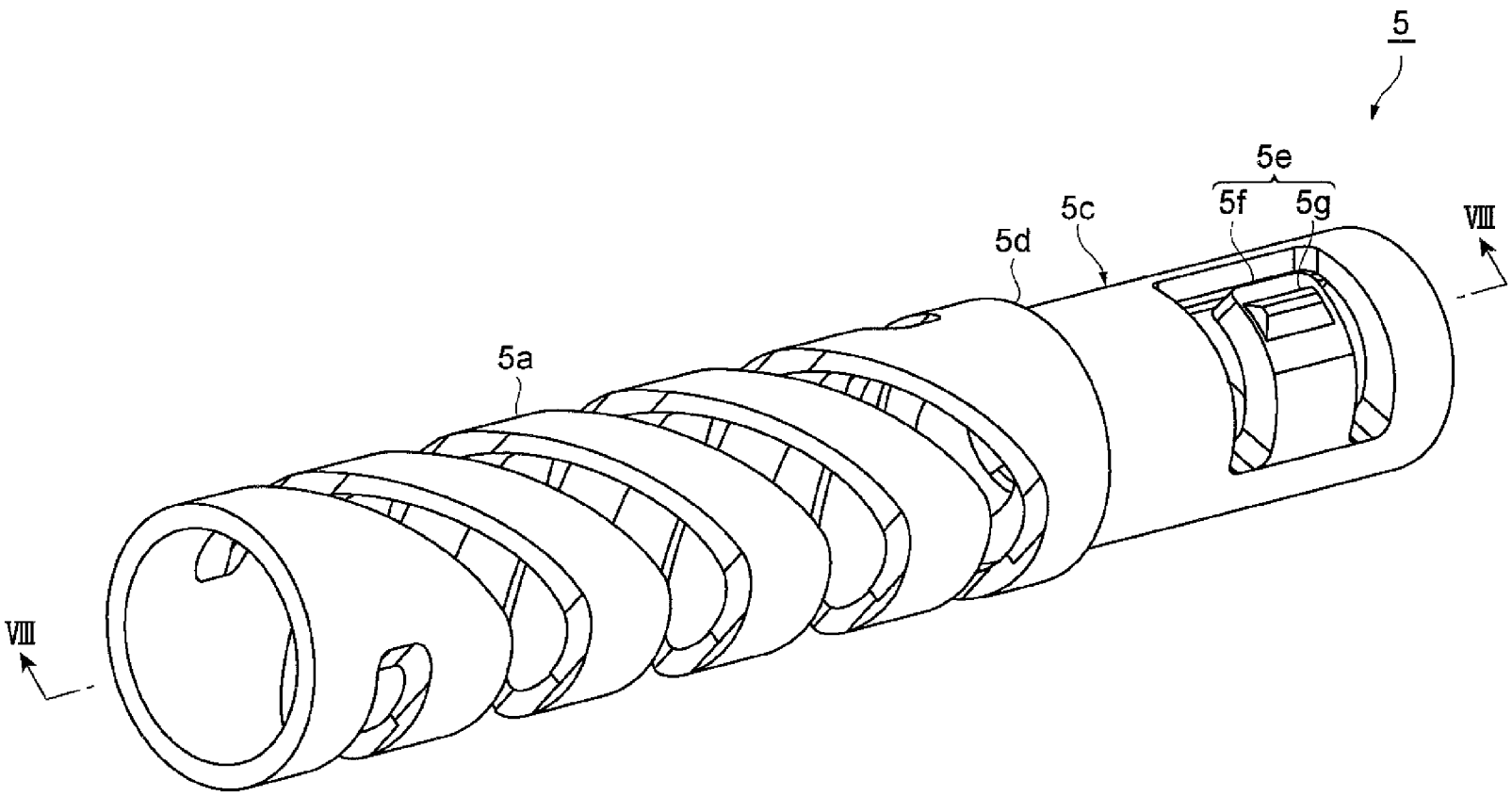
FIG. 7 is a perspective view illustrating a rotation stopper tube in FIG. 1.
Figure 8:
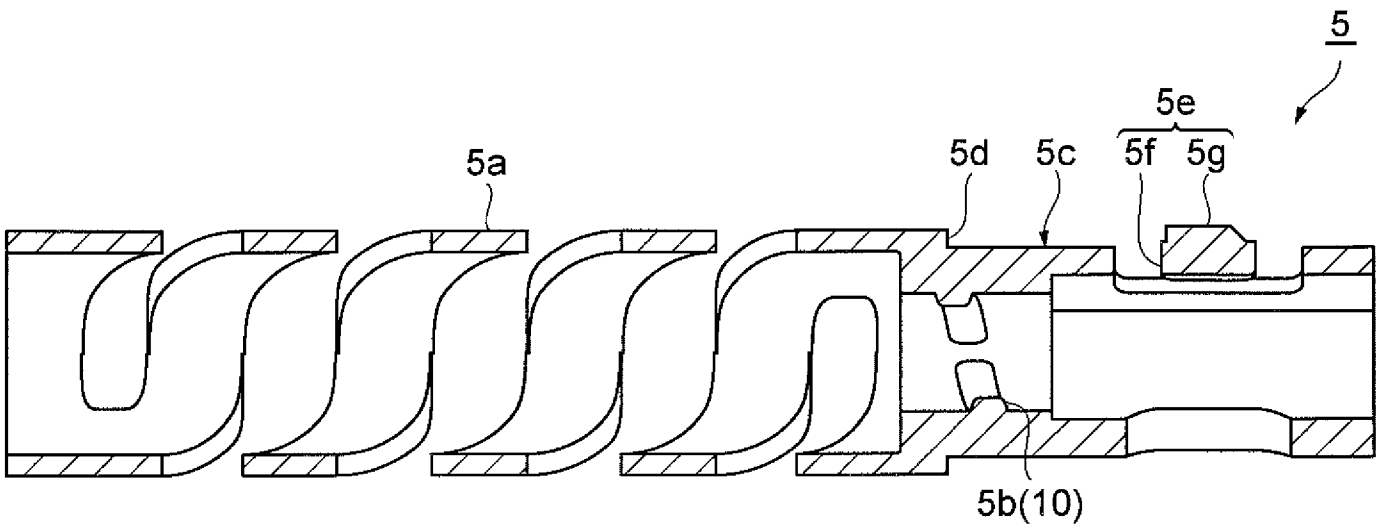
FIG. 8 is a cross-sectional view taken along the line VIII-VIII in FIG. 7.
Figure 9:
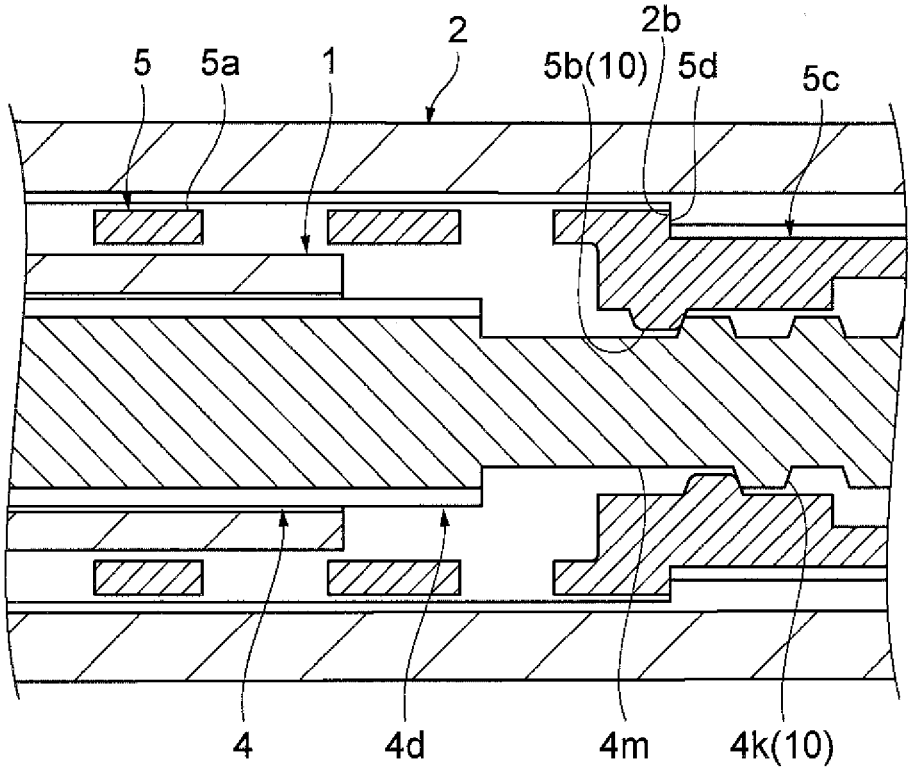
FIG. 9 is an enlarged cross-sectional view illustrating a state of the rod-shaped cosmetic material supporting body illustrated in FIG. 1 reaching the backward limit.

A preferred embodiment of a rod-shaped cosmetic material feeding container according to the present disclosure will be described below with reference to FIG. 1 to FIG. 8. FIG. 1 is a vertical cross-sectional view illustrating an initial state of a rod-shaped cosmetic material feeding container according to one embodiment of the present disclosure and a state of a rod-shaped cosmetic material supporting body reaching a backward limit. FIG. 2 is a vertical cross-sectional view illustrating a state where a cap is removed and the rod-shaped cosmetic material supporting body reaches a forward limit by a user's operation. FIG. 3 is a perspective view illustrating a cross section of a container main body. FIG. 4 is a perspective view illustrating a cross section of a joint tube. FIG. 5 is a perspective view illustrating a cross section of a leading tube. FIG. 6 is a perspective view illustrating the rod-shaped cosmetic material supporting body. FIG. 7 and FIG. 8 are perspective views each illustrating a rotation stopper tube. FIG. 9 is an enlarged cross-sectional view illustrating a state of the rod-shaped cosmetic material supporting body reaching the backward limit. The rod-shaped cosmetic material feeding container of this embodiment houses, for example, various rod-shaped cosmetic materials such as an eye liner, an eyebrow, a lip liner, and a concealer. The user can appropriately cause the cosmetic material to appear and disappear as needed. In the following description, an "axis line" means a center line of the rod-shaped cosmetic material feeding container extending forward and rearward. An "axial direction" means a direction along the axis line (a front-rear direction).

As illustrated in FIG. 1 and FIG. 2, a rod-shaped cosmetic material feeding container 100 entirely has a round bar (a stick) shape elongate like a writing material and features a good appearance. The rod-shaped cosmetic material feeding container 100 includes a leading tube 1, which constitutes a front container part, a container main body 2, which constitutes a rear container part, and a joint tube 3, which constitutes an intermediate portion of the container, as an external constitution. The rod-shaped cosmetic material feeding container 100 houses a rod-shaped cosmetic material M, which has an elongate round bar shape, a rod-shaped cosmetic material supporting body 4, and a rotation stopper tube 5, which forms one part of a screw part 10 in these leading tube 1, container main body 2, and joint tube 3. The rod-shaped cosmetic material supporting body 4 is a movable body that supports the rod-shaped cosmetic material M and includes the other part of the screw part 10. The rod-shaped cosmetic material feeding container 100 further includes an applicator 6 at a rear end portion of the container main body 2.

A front portion cap 7 is removably mounted to a front portion side of the rod-shaped cosmetic material feeding container 100. The front portion cap 7 covers a front end side of the rod-shaped cosmetic material feeding container 100 to protect the rod-shaped cosmetic material M. A rear portion cap 8 is removably mounted to a rear portion side of the rod-shaped cosmetic material feeding container 100 to cover the applicator 6 for protection.

As illustrated in FIG. 3, the container main body 2 has a cylindrical shape. The container main body 2 includes first protrusions (ribs) 2*a*, which extend in the axial direction, at a plurality of positions (equally spaced 12 positions in this embodiment) at the middle of the inner peripheral surface in the axial direction along a circumferential direction. The container main body 2 includes second protrusions 2*c*, which extend in the axial direction, at a plurality of positions (equally spaced four positions in this embodiment) along the circumferential direction such that top end surfaces 2*d* are positioned on the rear portion side with respect to top end surfaces 2*b* of the first protrusions 2*a*. The second protrusion 2*c* is formed so as to be higher than the first protrusion 2*a* inward in a radial direction. To prevent the rod-shaped cosmetic material supporting body 4 from retreating, the top end surfaces 2*d* of the second protrusions 2*c* are struck against a rear end surface 4*n* of the rod-shaped cosmetic material supporting body 4.

The container main body 2 includes third protrusions 2*e*, which extend in the axial direction, at a plurality of positions (equally spaced four positions in this embodiment) on the front portion side of the inner peripheral surface along the circumferential direction such that distal ends 2*f* are positioned near the distal end of the container main body 2. The third protrusions 2*e* is provided for engaging the joint tube 3 in a rotation direction around the axis line. A concave portion 2*g* is annularly disposed on the front side with respect to the distal ends 2*f* of the third protrusions 2*e* at the inner peripheral surface near a front end of the container main body 2. The concave portion 2*g* is formed for engaging the joint tube 3 in the axial direction.

The container main body 2 includes an opening 2*h* on the rear end portion. A shaft portion 6*b*, which supports a brush 6*a* of the applicator 6, is fitted by insertion to the opening 2*h*. Before the applicator 6 is fitted by insertion, the opening 2*h* has an inner diameter smaller than an outer diameter of the shaft portion 6*b* of the applicator 6. The heated shaft portion 6*b* of the applicator 6 heats an inner peripheral portion of the opening 2*h* to soften the opening 2*h*, thus this shaft portion 6*b* is inserted into the opening 2*h*. Afterwards, through cooling and hardening, the shaft portion 6*b* is fitted to the opening 2*h* by insertion.

As illustrated in FIG. 4, the cylindrical joint tube 3 has a collar portion 3*a* at the middle of the outer peripheral surface in the axial direction. An inserted portion 3*b* is a cylinder portion, which is disposed on a rear side with respect to this collar portion 3*a*, inserted into the container main body 2. Grooves 3*c*, which extend in the axial direction, are disposed at a plurality of positions (equally spaced four positions corresponding to the third protrusions 2*e* in this embodiment) along the circumferential direction on the outer peripheral surface of the inserted portion 3*b*. The grooves 3*c* are engaged with the third protrusions 2*e* of the container main body 2 in the rotation direction around the axis line. A slope 3*d* is formed at a rear portion of the grooves 3*c*. The slope 3*d* widens as approaching to the rear portion side. The slope 3*d* guides the third protrusions 2*e* to the grooves 3*c*. A convex portion 3*e* whose rear portion is inclined in a mountain shape is annularly disposed between the collar portion 3*a* and the grooves 3*c* on the outer peripheral surface of the joint tube 3. The convex portion 3*e* engages the annular-shaped concave portion 2*g* of the container main body 2 in the axial direction.

A convex portion 3*f* is annularly disposed at the middle of the inner peripheral surface of the joint tube 3 in the axial direction. The convex portion 3*f* engages the leading tube 1 in the axial direction while ensuring rotating the leading tube 1 in the rotation direction around the axis line. The joint tube 3 includes front portion cap engaging pieces 3*g* at a plurality of positions (equally spaced three positions in this embodiment) along the circumferential direction at the outer peripheral surface on the front side with respect to the collar portion 3*a*. The front portion cap engaging pieces 3*g* engage the front portion cap 7 in the axial direction.

As illustrated in FIG. 1 and FIG. 2, the inserted portion 3*b* of the joint tube 3 is inserted into the distal end side of the container main body 2, and the top end surface of the container main body 2 is struck against the collar portion 3*a*. The grooves 3*c* are engaged with the third protrusions 2*e* of the container main body 2 in the rotation direction around the axis line (see FIG. 3 and FIG. 4). Consequently, the joint tube 3 is engaged with the container main body 2 in the axial direction and is synchronously rotatable around the axis line.

As illustrated in FIG. 5, the leading tube 1 is configured to have a stepped cylindrical shape where a stepped portion 1*a* is disposed at the middle of the outer peripheral surface in the axial direction. An outer diameter of the leading tube 1 on a front side with respect to the stepped portion 1*a* is larger than an outer diameter of the leading tube 1 on a rear side with respect to the stepped portion 1*a*. The cylinder portion on the rear side with respect to this stepped portion 1*a* is configured as an inserted portion 1*b*, which is to be inserted into the joint tube 3. A concave portion 1*c* is annularly disposed on the outer peripheral surface of the inserted portion 1*b*. The concave portion 1*c* engages the annular-shaped convex portion 3*f* of the joint tube 3 in the axial direction.

A tube hole, which passes through the leading tube 1 in the axial direction, from the distal end to around the middle in the axial direction, is configured as a rod-shaped cosmetic material hole 1*e*. The rod-shaped cosmetic material hole 1*e* slidably houses the rod-shaped cosmetic material M. From a terminating end of the rod-shaped cosmetic material hole 1*e* to the rear end of this tube hole is configured as a rod-shaped cosmetic material supporting body hole 1*f*. The rod-shaped cosmetic material supporting body hole 1*f* slidably houses the rod-shaped cosmetic material supporting body 4, which supports the rod-shaped cosmetic material M.

The leading tube 1 includes protrusions 1*g*, which extend in the axial direction, at a plurality of positions (equally spaced four positions in this embodiment) along the circumferential direction at the inner peripheral surface of the rod-shaped cosmetic material hole 1*e*. A space between the protrusions 1*g* adjacent to one another specifies a support piece groove 1*h*. The support piece groove 1*h* slidably houses support pieces 4*g*, which will be described later, of the rod-shaped cosmetic material supporting body 4. These rod-shaped cosmetic material hole 1*e* and support piece groove 1*h* constitute an advance/retreat hole 1*i* into which the rod-shaped cosmetic material M and the support pieces 4*g* slide.

Rotation stopper piece grooves 1*j*, which extend in the axial direction, are disposed at a plurality of positions (equally spaced four positions in this embodiment) along the circumferential direction on the inner peripheral surface of the rod-shaped cosmetic material supporting body hole if in the leading tube 1. The rotation stopper piece grooves 1*j* slidably house rotation stopper pieces 4*i* in a rotation stopper 4*d*, which will be described later, of the rod-shaped cosmetic material supporting body 4. The rod-shaped cosmetic material supporting body hole if and the rotation stopper piece grooves 1*j* constitute an advance/retreat hole 1*k* into which the rotation stopper pieces 4*i* slide.

As illustrated in FIG. 1 and FIG. 2, the inserted portion 1*b* of the leading tube 1 is inserted into the distal end side of the joint tube 3. The top end surface of the joint tube 3 is struck against the stepped portion 1*a*, and the convex portion 3*f* of the joint tube 3 is engaged with the concave portion 1*c*, which is on the outer peripheral surface of the inserted portion 1*b*, in the axial direction. This engages the leading tube 1 with the joint tube 3 in the axial direction and is rotatable around the axis line. On the outer peripheral surface of the inserted portion 1*b*, an O-ring groove 1*d*, which mounts an O-ring 9, is annularly disposed. The O-ring 9, which is mounted to the O-ring groove 1*d*, is sandwiched with the leading tube 1 and the joint tube 3 to provide a good rotational resistance during the relative rotation of the leading tube 1 and the joint tube 3.

As illustrated in FIG. 6, the rod-shaped cosmetic material supporting body 4 includes a supporting portion 4*a*, an impact absorbing portion 4*b*, a coupling portion 4*c*, the rotation stopper 4*d*, and a shaft body portion 4*e*. The supporting portion 4*a* supports the rear end portion of the rod-shaped cosmetic material M. The impact absorbing portion 4*b* is adjacent to the rear end portion of the supporting portion 4*a* and has a small-diameter columnar shape. The coupling portion 4*c* is adjacent to the rear end portion of the impact absorbing portion 4*b* and has a columnar shape with a diameter larger than the impact absorbing portion 4*b*. The rotation stopper 4*d* is adjacent to the rear end portion of the coupling portion 4*c*. The rotation stopper 4*d* causes this rod-shaped cosmetic material supporting body 4 to engage the leading tube 1 in the rotation direction around the axis line and to be movable in the axial direction. The shaft body portion 4*e* is adjacent to the rear end side of the rotation stopper 4*d*.

The supporting portion 4*a* has an approximately tubular shape with bottom open forward. An inner diameter of the supporting portion 4*a* corresponds to an outer diameter of the rod-shaped cosmetic material M. The supporting portion 4*a* includes a base portion 4*f* and the plurality of support pieces 4*g*. The base portion 4*f* is struck against the rear end surface of the rod-shaped cosmetic material M. The support pieces 4*g* support the rear end portion of the rod-shaped cosmetic material M, which is struck against the base portion 4*f* by the rear end surface. The support pieces 4*g* are disposed at a plurality of positions (equally spaced four positions in this embodiment) on the outer peripheral surface of the base portion 4*f* along the circumferential direction so as to project to the distal end side. The supporting portion 4*a* supports the rod-shaped cosmetic material M sandwiching the rod-shaped cosmetic material M with these support pieces 4*g*.

When external force radially acts between the supporting portion 4*a* and the coupling portion 4*c*, the impact absorbing portion 4*b* radially bends and absorbs the external force by elastic force. The rotation stopper 4*d* includes a base portion 4*h* and the rotation stopper pieces 4*i*. The base portion 4*h* has a columnar shape with a diameter larger than the coupling portion 4*c*. The rotation stopper pieces 4*i* extend from a front end portion to a rear end portion of the outer peripheral surface of the base portion 4*h* in the axial direction. The rotation stopper pieces 4*i* are disposed at a plurality of positions (equally spaced four positions in this embodiment) along the circumferential direction on the outer peripheral surface of the base portion 4*h* so as to radially project outward.

The shaft body portion 4*e* is a shaft body extending from the rear end portion of the rotation stopper 4*d* in the axial direction. On the shaft body portion 4*e*, a male screw 4*k*, which constitutes one part of the screw part 10, is formed on the outer peripheral portion from a neighborhood of the front end to the rear end portion. The male screw 4*k* is not formed on the front end portion of the shaft body portion 4*e*. A thin-diameter portion 4*m*, which has a columnar shape with a diameter smaller than an outer diameter of the male screw 4*k* and an outer diameter of the base portion 4*h* of the rotation stopper 4*d*, is formed on the front end portion. The thin-diameter portion 4*m* is formed from the rear end of the rotation stopper 4*d* to the front end of the male screw 4*k*. This thin-diameter portion 4*m* is formed to have a diameter smaller than an inner diameter of a female screw 5*b*, which will be described later, of the rotation stopper tube 5 and is formed longer than a front-to-rear length of the female screw 5*b*.

As illustrated in FIG. 1 and FIG. 2, the base portion 4*f* of the rod-shaped cosmetic material supporting body 4 enters the rod-shaped cosmetic material hole 1*e* of the leading tube 1, and the support pieces 4*g* enter the support piece grooves 1*h* of the leading tube 1. Thus, the cosmetic material supporting body 4 is inserted into the tube hole of the leading tube 1. This allows the supporting portion 4*a* to be movable inside the tube hole of the leading tube 1 in the axial direction. At this time, between the support pieces 4*g* and the support piece grooves 1*h* where these support pieces 4*g* enter, a minute space is radially formed. This allows a slight displacement of the supporting portion 4*a* in the radial direction caused by the impact absorbing portion 4*b* of the rod-shaped cosmetic material supporting body 4 and the spring portion 5*a* of the rotation stopper tube 5 as described later.

The rotation stopper 4*d* of the rod-shaped cosmetic material supporting body 4 enters the rod-shaped cosmetic material supporting body hole if of the leading tube 1, and the rotation stopper pieces 4*i* enter the rotation stopper piece grooves 1*j* on the leading tube 1. Thus, the rod-shaped cosmetic material supporting body 4 is inserted into the advance/retreat hole 1*k*. This causes the rotation stopper piece grooves 1*j* to serve as a rotation stopper for the rod-shaped cosmetic material supporting body 4. Therefore, the rod-shaped cosmetic material supporting body 4 is engaged with the leading tube 1 in the rotation direction around the axis line and is movable in the axial direction. Positions at which top end surfaces 4*j* of the rotation stopper pieces 4*i* strike against top end surfaces 1*m* of the rotation stopper piece grooves 1*j* on the leading tube 1 by the advance of the rod-shaped cosmetic material supporting body 4 in the axial direction are forward limit of the rod-shaped cosmetic material supporting body 4 (another movement limit) (see FIG. 2).

As illustrated in FIG. 7 and FIG. 8, the rotation stopper tube 5 has an approximately cylindrical shape and has the spring portion 5*a* on the front portion side and a screw cylinder portion 5*c* on the rear portion side. The spring portion 5*a* is expandable in the axial direction and has flexibility in the radial direction. The screw cylinder portion 5*c* has the female screw 5*b* on the inner peripheral portion. The female screw 5*b* is screwed with the male screw 4*k* of the rod-shaped cosmetic material supporting body 4 to constitute the screw part 10. These spring portion 5*a* and screw part 10 constitute a first clutch mechanism, which will be described later. An outer diameter of the spring portion 5*a* is larger than an outer diameter of the screw cylinder portion 5*c*. The rear end portion of the spring portion 5*a* forms a stepped portion 5*d*. The screw cylinder portion 5*c* includes a rotation stopper vent portion 5*e*. The rotation stopper vent portion 5*e* causes the rotation stopper tube 5 to be synchronously rotatable with respect to the container main body 2 around the axis line and causes this synchronous rotation to be releasable (relatively rotatable). The rotation stopper vent portion 5*e* and the first protrusions 2*a* (see FIG. 3) on the container main body 2 constitute a second clutch mechanism, which will be described later.

The rotation stopper vent portion 5*e* includes an arm 5*f*, which circumferentially extends, and a convex portion 5*g*. The convex portion 5*g* is disposed at a tip end of the arm 5*f* and radially projects outward. The arm 5*f* forms a U-shaped slit at the screw cylinder portion 5*c*. The arm 5*f* radially bends around the base end side to provide radial elastic force caused by the material to the convex portion 5*g*. The convex portion 5*g* has a protrusion shape extending in the axial direction and both sides of the convex portion 5*g* in the circumferential direction are inclined in a mountain shape. The arm 5*f* may extend to any direction in the circumferential direction, or the arm 5*f* may extend to the axial direction as long as the radial elastic force can be provided to the convex portion 5*g*. The rotation stopper vent portion 5*e* has the one arm 5*f* and the one convex portion 5*g*; however, the rotation stopper vent portion 5*e* may have a plurality of the arms 5*f* and the convex portions 5*g*. For example, the rotation stopper vent portion 5*e* may include the arms 5*f* and the convex portions 5*g* at a plurality of positions (for example, in the case of the two arms 5*f* and two the convex portions 5*g*, the positions are equally spaced two positions) along the circumferential direction.

As illustrated in FIG. 1 and FIG. 2, the rotation stopper tube 5 is inserted into the container main body 2. In a state where the front end surface of the spring portion 5*a* contacts the rear end surface of the joint tube 3 and the spring portion 5*a* is slightly compressed, the stepped portion 5*d* contacts the top end surfaces 2*b* of the first protrusions 2*a* on the container main body 2. Thus, the rotation stopper tube 5 is sandwiched between the container main body 2 and the joint tube 3 and housed.

The female screw 5*b* on the rotation stopper tube 5 is screwed with the male screw 4*k* on the rod-shaped cosmetic material supporting body 4 to constitute the screw part 10. At this time, the convex portion 5*g* on the rotation stopper vent portion 5*e* is positioned between the first protrusions 2*a* on the container main body 2. Accordingly, the rotation stopper tube 5 engages the container main body 2 and is synchronously rotatable around the axis line. Accordingly, the relative rotation between the leading tube 1 and the container main body 2 works the screw part 10, allowing the rod-shaped cosmetic material supporting body 4 to advance and retreat.

The following describes actions of the rod-shaped cosmetic material feeding container 100. In an initial state illustrated in FIG. 1, the user removes the front portion cap 7 of the rod-shaped cosmetic material feeding container 100 to expose the leading tube 1. After that, the user relatively rotates the leading tube 1 and the container main body 2 in another direction (a direction opposite from one direction), which is a feed direction of the rod-shaped cosmetic material M. Then, the rod-shaped cosmetic material supporting body 4, which synchronously rotates with respect to the leading tube 1 around the axis line, and the rotation stopper tube 5, which is synchronously rotatable with respect to the container main body 2 around the axis line, are relatively rotated in the other direction. This works a screwing action by the screw part 10, which is constituted of the male screw 4*k* of the rod-shaped cosmetic material supporting body 4 and the female screw 5*b* of the rotation stopper tube 5.

Consequently, the rod-shaped cosmetic material supporting body 4 can advance with respect to the leading tube 1, and the rotation stopper tube 5 is restricted to retreat with respect to the container main body 2. Accordingly, the rod-shaped cosmetic material supporting body 4 advances and the rod-shaped cosmetic material M appears from an opening 1*n*, which is at the distal end of the leading tube 1, thus the rod-shaped cosmetic material M is applicable in a usage state. At this time, since the leading tube 1 and the joint tube 3 relatively rotate, the relative rotation is performed at a first rotating torque according to a rotational resistance provided by the O-ring 9, which is sandwiched between the leading tube 1 and the joint tube 3, and the inner peripheral surface of the joint tube 3.

Further, the relative rotation of the leading tube 1 and the container main body 2 in the other direction by the first rotating torque further advances the rod-shaped cosmetic material supporting body 4. As illustrated in FIG. 2, when the top end surfaces 4*j* of the rotation stopper pieces 4*i* strike against the top end surfaces 1*m* of the rotation stopper piece grooves 1*j* at the leading tube 1, the rod-shaped cosmetic material supporting body 4 reaches the forward limit. With the first rotating torque at the forward limit, the leading tube 1 and the container main body 2 do not relatively rotate in the other direction any further. If the relative rotation is attempted by a second rotating torque, which is larger than the first rotating torque, the arm 5*f* in the rotation stopper vent portion 5*e* of the rotation stopper tube 5 bends radially inward. This causes the convex portion 5*g*, which is disposed on the arm 5*f*, to exceed the first protrusions 2*a* on the container main body 2, thereby releasing the engagement. Consequently, the synchronous rotation between the rotation stopper tube 5 and the container main body 2 around the axis line is released. With this state, even if the leading tube 1 and the container main body 2 are relatively rotated further in the other direction, since the rotation stopper tube 5 and the container main body 2 relatively rotate, the rod-shaped cosmetic material supporting body 4 and the rotation stopper tube 5 do not relatively rotate; therefore, the screwing action by the screw part 10 does not work. Even if the leading tube 1 and the container main body 2 are relatively rotated further in the other direction, since the screwing action by the screw part 10 does not work, the rod-shaped cosmetic material supporting body 4 does not attempt to advance further from the forward limit and does not press the leading tube 1 forward at a strong force. This prevents the leading tube 1 and the joint tube 3, which is engaged with the leading tube 1, from separating from the container main body 2.

As described above, the second clutch mechanism, which is constituted of the rotation stopper vent portion 5*e* of the rotation stopper tube 5 and the first protrusions 2*a* on the container main body 2, functions as a so-called clutch of the screw part 10 at the forward limit of the rod-shaped cosmetic material supporting body 4.

When the user relatively rotates the leading tube 1 and the container main body 2 in the one direction, which is the returning direction, the screwing action by the screw part 10 works to retreat the rod-shaped cosmetic material supporting body 4, and the rod-shaped cosmetic material M sinks from the opening 1*n*, which is at the distal end of the leading tube 1.

The further relative rotation of the leading tube 1 and the container main body 2 in the one direction further retreats the rod-shaped cosmetic material supporting body 4. The rear end surface 4*n* of the rod-shaped cosmetic material supporting body 4 strikes against the top end surfaces 2*d* of the second protrusions 2*c* on the container main body 2, thus reaching the backward limit (the movement limit). At the backward limit, the further relative rotation in the one direction shrinks the spring portion 5*a* with the movement of the rod-shaped cosmetic material supporting body 4 stopped. Then, a position where the male screw 4*k* is screwed with the female screw 5*b* moves, moving the screw cylinder portion 5*c* forward. Thus, since the screw part 10 screws forward, the female screw 5*b* exceeds the male screw 4*k* and reaches the thin-diameter portion 4*m*, releasing the screwing of the screw part 10 (see FIG. 9). Consequently, at the backward limit, even if the leading tube 1 and the container main body 2 are further relatively rotated in the one direction continuously, the rod-shaped cosmetic material supporting body 4 and the rotation stopper tube 5 relatively rotate (idles) while the movement of the rod-shaped cosmetic material supporting body 4 is stopped and the screwing of the screw part 10 is released.

With the screwing of the screw part 10 released, the elastic force by the shrunk spring portion 5*a* biases the female screw 5*b* to the male screw 4*k*. Therefore, the relative rotation of the leading tube 1 and the container main body 2 in the other direction, which is the feed direction, easily engages the end portion of the female screw 5*b* on the male screw 4*k* side with an end portion of the male screw 4*k* on the female screw 5*b* side. With the screwing of the screw part 10 released, the relative rotation of the leading tube 1 and the container main body 2 in the other direction easily recovers the screwing between the female screw 5*b* and the male screw 4*k*.

As described above, the first clutch mechanism, which is constituted of the spring portion 5*a* and the screw part 10, functions as a so-called clutch of the screw part 10 at the backward limit of the rod-shaped cosmetic material supporting body 4. The first clutch mechanism acts in a state where the movement of the rod-shaped cosmetic material supporting body 4 is stopped at the backward limit; therefore, even if the release of screwing and the recovery of screwing of the screw part 10 is repeated, the rod-shaped cosmetic material supporting body 4 does not move back and forth in the axial direction. Therefore, the rod-shaped cosmetic material M, which is supported to the distal end of the rod-shaped cosmetic material supporting body 4, also does not move back and forth in the axial direction, minimizing an impact to the rod-shaped cosmetic material M.

Furthermore, the rod-shaped cosmetic material M is coupled to the rotation stopper tube 5 via the rod-shaped cosmetic material supporting body 4 and the screw part 10. In view of this, when the external force acts on the rod-shaped cosmetic material M in the axial direction, the external force is transmitted from the rod-shaped cosmetic material M to the rotation stopper tube 5 via the screw part 10, expanding and contracting the spring portion 5*a* in the axial direction. Accordingly, the external force is absorbed by the elastic force from the spring portion 5*a*. This sufficiently protects the rod-shaped cosmetic material M from the external force.

Since the support pieces 4*g* at the rod-shaped cosmetic material supporting body 4 form minute spaces with the support piece grooves 1*h* at the leading tube 1 into which these support pieces 4*g* enter, a slight displacement is allowed in the radial direction.

In view of this, in the case where the external force radially acts on the rod-shaped cosmetic material M, the external force radially bends the impact absorbing portion 4*b* on the rod-shaped cosmetic material supporting body 4 and the spring portion 5*a* in the rotation stopper tube 5. Accordingly, the elastic force by the impact absorbing portion 4*b* and the spring portion 5*a* absorb the external force, thereby sufficiently protecting the rod-shaped cosmetic material M from the external force.

With the rod-shaped cosmetic material feeding container 100 according to the embodiment, assume the case where the leading tube 1 and the container main body 2 are relatively rotated in the one direction, which is the returning direction, the rod-shaped cosmetic material supporting body 4 retreats and reaches the backward limit, and subsequently the leading tube 1 and the container main body 2 are further relatively rotated in the one direction. With the retreat of the rod-shaped cosmetic material supporting body 4 stopped, while the spring portion 5*a* shrinks, the screw part 10 screws forward, thus releasing the screwing of the screw part 10. Accordingly, even if this relative rotation is further continued, the screw part 10 released from the screwing idles. This does not generate a force to further retreat the rod-shaped cosmetic material supporting body 4 that has reached the backward limit by the screw part 10, thereby ensuring minimizing damage to the container. At this time, the retreat of the rod-shaped cosmetic material supporting body 4 is stopped; therefore, the rod-shaped cosmetic material supporting body 4 does not move back and forth in the axial direction. Accordingly, the rod-shaped cosmetic material M, which is supported to the distal end of the rod-shaped cosmetic material supporting body 4, also does not move back and forth in the axial direction, thereby ensuring minimizing the impact to the rod-shaped cosmetic material. As described above, the rod-shaped cosmetic material M can be sufficiently protected while the damage of the container is restrained.

In this embodiment, the rod-shaped cosmetic material supporting body 4 includes the thin-diameter portion 4*m*, which has the outer diameter smaller than the inner diameter of the female screw 5*b*, at a position adjacent to the end portion of the male screw 4*k*. After the rod-shaped cosmetic material supporting body 4 retreats and reaches the backward limit, when the leading tube 1 and the container main body 2 are further relatively rotated in the one direction, with the retreat of the rod-shaped cosmetic material supporting body 4 stopped, while the spring portion 5*a* shrinks, the screw part 10 screws forward, and the female screw 5*b* reaches the thin-diameter portion 4*m*, thus releasing the screwing of the screw part 10.

In this embodiment, with the screwing of the screw part 10 released, the elastic force by the shrunk spring portion 5*a* biases the female screw 5*b* to the male screw 4*k*. In this configuration, the relative rotation of the leading tube 1 and the container main body 2 to the other direction, which is the feed direction, with the screwing of the screw part 10 released allows the female screw 5*b* and the male screw 4*k* released from the screwing to easily recover the screwing by the elastic force from the spring portion 5*a*.

According to this embodiment, the leading tube 1 and the container main body 2 are relatively rotated at the first rotating torque in the other direction, the rod-shaped cosmetic material supporting body 4 advances and reaches the forward limit, and then the leading tube 1 and the container main body 2 are further relatively rotated at the second rotating torque, which is larger than the first rotating torque, in this other direction. Then, the synchronous rotation between the rotation stopper tube 5 and the container main body 2 around the axis line is released. In this configuration, when the leading tube 1 and the container main body 2 are relatively rotated in the other direction, the rod-shaped cosmetic material supporting body 4 moves forward and reaches the forward limit, and then the leading tube 1 and the container main body 2 are further relatively rotated in this other direction, the synchronous rotation between the rotation stopper tube 5 and the container main body 2 is released. This stops the relative rotation between the rotation stopper tube 5, which includes the female screw 5*b*, and the rod-shaped cosmetic material supporting body 4, which includes the male screw 4*k*. This does not generate a force to further advance the rod-shaped cosmetic material supporting body 4 that has reached the forward limit by the screw part 10, thereby ensuring minimizing damage to the container.

In this embodiment, the container main body 2 includes the plurality of first protrusions 2*a*, which extend in the axial direction, at the inner peripheral portion. The rotation stopper tube 5 includes the rotation stopper vent portion 5*e*, which includes the convex portion 5*g* projecting radially outward, that has flexibility in a direction along a radial direction. The engagement of the convex portion 5*g* between the adjacent first protrusions 2*a* allows the synchronous rotation with respect to the container main body 2 around the axis line. Assume the case where the rod-shaped cosmetic material supporting body 4 reaches the forward limit and then the leading tube 1 and the container main body 2 are further relatively rotated in the other direction. While the rotation stopper vent portion 5*e* bends radially inward, the rotation stopper tube 5 relatively rotates with respect to the container main body 2 around the axis line. The convex portion 5*g* exceeds the first protrusions 2*a* to release the engagement. Thus, the synchronous rotation of the rotation stopper tube 5 and the container main body 2 around the axis line is released. This configuration ensures preferably providing the action of releasing the synchronous rotation between the rotation stopper tube 5 and the container main body 2 around the axis line.

With the spring portion 5*a* of this embodiment, the elastic force generated by the stretch or the contraction of the spring portion 5*a* absorbs the external force applied to the rod-shaped cosmetic material M, which is also the external force transmitted from this rod-shaped cosmetic material M to the rotation stopper tube 5 via the rod-shaped cosmetic material supporting body 4 and the screw part 10. This ensures further sufficiently protecting the rod-shaped cosmetic material M.

The description has been given about the preferable embodiment according to the present disclosure; however, the rod-shaped cosmetic material feeding container according to the present disclosure is not limited to the embodiment mentioned above, but may be modified within a range which does not change the scope described in each of claims, or may be applied to the other structures.

Figure 10:
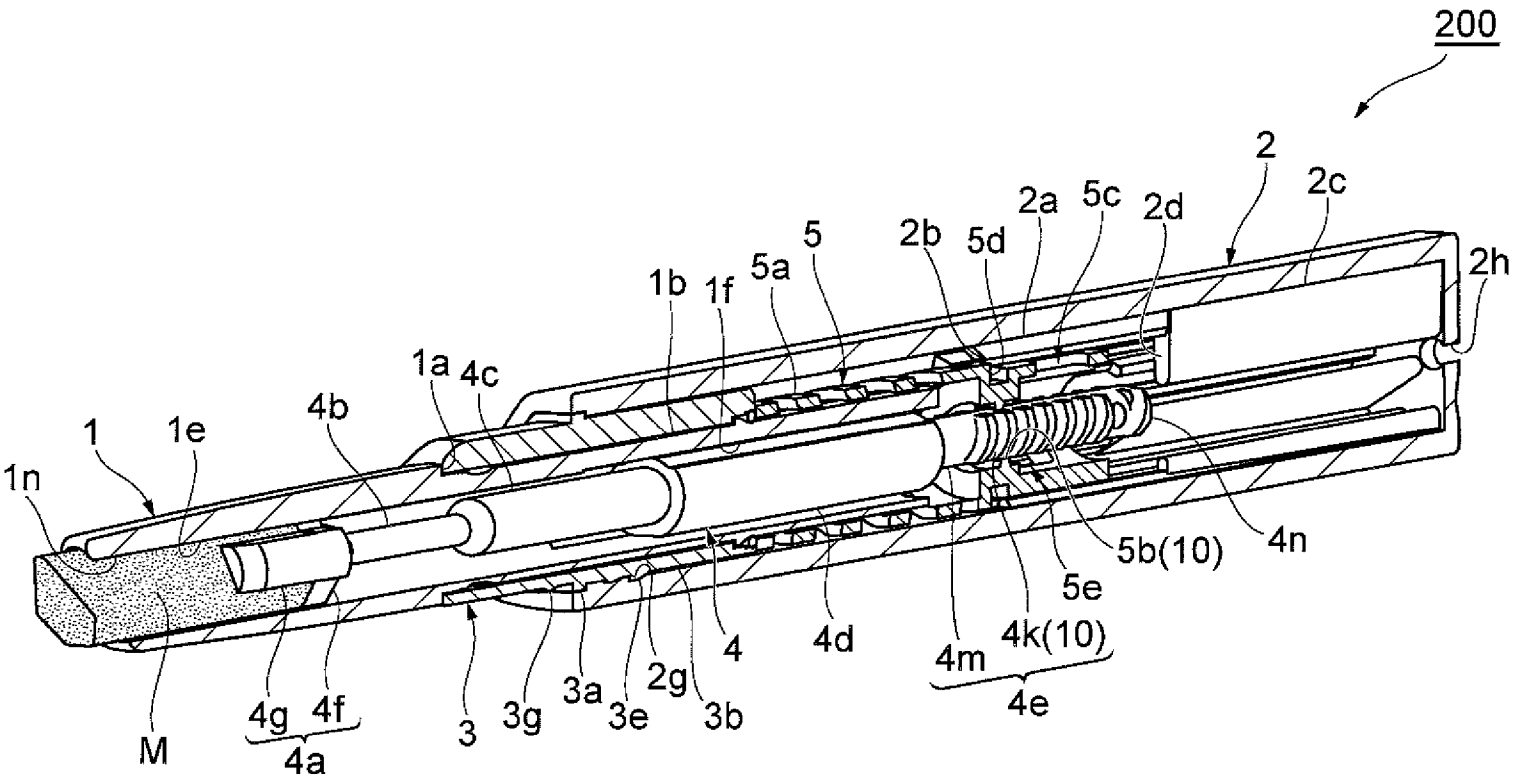
FIG. 10 is a perspective view illustrating a cross section of a part of a rod-shaped cosmetic material feeding container according to a modification.

FIG. 10 is a perspective view illustrating a cross section of a part of a rod-shaped cosmetic material feeding container according to a modification. FIG. 10 illustrates an example of a rod-shaped cosmetic material feeding container 200 where the applicator 6 is not fitted to the opening 2*h* on the container main body 2 by insertion. For example, as illustrated in FIG. 10, the rod-shaped cosmetic material feeding container 200 according to the modification is provided with the rod-shaped cosmetic material M whose lateral cross-sectional surface (a cross section perpendicular to the axial direction) forms a polygonal shape. The rod-shaped cosmetic material feeding container 200 according to this modification also provides the advantageous effects that ensure sufficiently protect the rod-shaped cosmetic material M while minimizing the damage of the container. The shape of the rod-shaped cosmetic material M is not limited, and various shapes are selectable. For example, the rod-shaped cosmetic material M may have an elliptically-shaped lateral cross-sectional surface, and the distal end may have an obliquely cut shape.

With the embodiment described above, assume the case where the leading tube 1 and the container main body 2 are relatively rotated in the one direction, the rod-shaped cosmetic material supporting body 4 retreats and reaches the backward limit, and then the leading tube 1 and the container main body 2 are further relatively rotated in this one direction. With the retreat of the rod-shaped cosmetic material supporting body 4 stopped, while the spring portion 5*a* shrinks, the screw part 10 screws forward, thus releasing the screwing of the screw part 10. However, instead of such configuration or adding to this configuration, the following configuration may be employed. When the leading tube 1 and the container main body 2 are relatively rotated in the other direction, the rod-shaped cosmetic material supporting body 4 advances and reaches the forward limit, and then the leading tube 1 and the container main body 2 are further relatively rotated in this other direction, with the advance of the rod-shaped cosmetic material supporting body 4 stopped, the screw part screws forward while the spring portion shrinks, thus releasing the screwing of the screw part.

With the embodiment, the stepped portion 5*d* of the rotation stopper tube 5 is brought in contact with the top end surface 2*b* of the first protrusion 2*a* of the container main body 2 to position the container main body 2 in the axial direction. However, the site of the container main body 2 with which the rotation stopper tube 5 is in contact is not limited. For example, the following configuration may be employed. Fourth protrusions are additionally disposed at a plurality of positions along the circumferential direction on the rear portion side at the inner peripheral surface of the container main body 2. The fourth protrusions extend in the axial direction such that top end surfaces of the fourth protrusions are positioned on a rear portion side with respect to the top end surfaces 2*b* of the first protrusions 2*a* and are formed radially higher than the first protrusions 2*a*. Bringing the stepped portion 5*d* in contact with the top end surface of the fourth protrusion positions the container main body 2 in the axial direction.

It is only necessary that the male screw 4*k* and the female screw 5*b* work similar to a screw thread like a group of projections intermittently disposed or a group of projections spirally and intermittently disposed. Additionally, the rod-shaped cosmetic material feeding container 100 may employ a constitution not having the second clutch mechanism.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the scope of the present disclosure as defined by the appended claims.

What is claimed is:

1. A rod-shaped cosmetic material feeding container comprising:

a tubular container that has a front container part and a rear container part;

a movable body engaged with the front container part in a rotation direction around an axis line, the movable body being movable in an axial direction, the movable body supporting a rod-shaped cosmetic material at a distal end and including a male screw at an outer peripheral portion; and a rotation stopper tube rotatable with respect to the front container part around the axis line, the rotation stopper tube being synchronously rotatable with respect to the rear container part around the axis line, the rotation stopper tube including a female screw at an inner peripheral portion, the female screw being screwed with the male screw, wherein:

a relative rotation of the front container part and the rear container part works a screw part constituted of the male screw and the female screw to advance and retreat the movable body, the relative rotation causes the rod-shaped cosmetic material to appear and disappear from an opening at a distal end of the container, the rotation stopper tube includes a spring portion expandable and contractible in the axial direction, and if the front container part and the rear container part are relatively rotated in one direction, the movable body moves and reaches a movement limit, and the front container part and the rear container part are further relatively rotated in the one direction, the screw part screws forward while the spring portion shrinks with the movement of the movable body stopped to release the screwing of the screw part.

2. The rod-shaped cosmetic material feeding container according to claim 1, wherein the movement limit is at least one of a forward limit and a backward limit.

3. The rod-shaped cosmetic material feeding container according to claim 2, wherein:

the movable body includes a thin-diameter portion positioned adjacent to an end portion of the male screw, the thin-diameter portion having an outer diameter smaller than an inner diameter of the female screw, and if the movable body moves and reaches the movement limit and the front container part and the rear container part are further relatively rotated in the one direction, while the spring portion shrinks, the screw part screws forward and the female screw reaches the thin-diameter portion with the movement of the movable body stopped to release the screwing of the screw part.

4. The rod-shaped cosmetic material feeding container according to claim 3, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

5. The rod-shaped cosmetic material feeding container according to claim 4, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

6. The rod-shaped cosmetic material feeding container according to claim 3, wherein with the screwing of the screw part released, an elastic force by the shrunk spring portion biases the female screw to the male screw.

7. The rod-shaped cosmetic material feeding container according to claim 6, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

8. The rod-shaped cosmetic material feeding container according to claim 7, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

9. The rod-shaped cosmetic material feeding container according to claim 2, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

10. The rod-shaped cosmetic material feeding container according to claim 9, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

11. The rod-shaped cosmetic material feeding container according to claim 2, wherein the spring portion absorbs an external force applied to the rod-shaped cosmetic material by the elastic force of the spring portion, the external force being transmitted from the rod-shaped cosmetic material to the rotation stopper tube via the movable body and the screw part.

12. The rod-shaped cosmetic material feeding container according to claim 1, wherein:

the movable body includes a thin-diameter portion positioned adjacent to an end portion of the male screw, the thin-diameter portion having an outer diameter smaller than an inner diameter of the female screw, and if the movable body moves and reaches the movement limit and the front container part and the rear container part are further relatively rotated in the one direction, while the spring portion shrinks, the screw part screws forward and the female screw reaches the thin-diameter portion with the movement of the movable body stopped to release the screwing of the screw part.

13. The rod-shaped cosmetic material feeding container according to claim 12, wherein with the screwing of the screw part released, an elastic force by the shrunk spring portion biases the female screw to the male screw.

14. The rod-shaped cosmetic material feeding container according to claim 13, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

15. The rod-shaped cosmetic material feeding container according to claim 14, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

16. The rod-shaped cosmetic material feeding container according to claim 12, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

17. The rod-shaped cosmetic material feeding container according to claim 16, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

18. The rod-shaped cosmetic material feeding container according to claim 1, wherein if the front container part and the rear container part are relatively rotated at a first rotating torque in another direction, the movable body moves and reaches another movement limit opposite from the movement limit, and then the front container part and the rear container part are further relatively rotated at a second rotating torque larger than the first rotating torque in the other direction, a synchronous rotation between the rotation stopper tube and the rear container part around the axis line is released.

19. The rod-shaped cosmetic material feeding container according to claim 18, wherein:

the rear container part includes a plurality of ribs extending in the axial direction at an inner peripheral portion, the rotation stopper tube includes a rotation stopper vent portion, the rotation stopper vent portion including a convex portion projecting radially outward, the rotation stopper vent portion having flexibility in a direction along a radial direction, engaging the convex portion between the ribs which are adjacent ensures a synchronous rotation with respect to the rear container part around the axis line, and when the movable body reaches the other movement limit and then the front container part and the rear container part are further relatively rotated in the other direction at the second rotating torque, while the rotation stopper vent portion bends radially inward, the rotation stopper tube relatively rotates with respect to the rear container part around the axis line and the convex portion exceeds the rib and releases the engagement to release the synchronous rotation between the rotation stopper tube and the rear container part around the axis line.

20. The rod-shaped cosmetic material feeding container according to claim 1, wherein the spring portion absorbs an external force applied to the rod-shaped cosmetic material by the elastic force of the spring portion, the external force being transmitted from the rod-shaped cosmetic material to the rotation stopper tube via the movable body and the screw part.

* * * * *